US006290146B1

(12) United States Patent
Tsai

(10) Patent No.: US 6,290,146 B1
(45) Date of Patent: Sep. 18, 2001

(54) WATER SPRINKLE DEVICE

(76) Inventor: Chien-liang Tsai, 23 Lane 310, Chen Kung Road, Eong Yuan City, Taichung Hsien (TW)

( * ) Notice: Subject to any disclaimer, the term of this patent is extended or adjusted under 35 U.S.C. 154(b) by 0 days.

(21) Appl. No.: 08/966,321

(22) Filed: Nov. 7, 1997

(51) Int. Cl.[7] ..... A62C 31/02

(52) U.S. Cl. ..... 239/394; 239/275; 239/DIG. 1

(58) Field of Search ..... 239/273, 275, 239/276, 390, 392, 494, 498, 500, 505, 521–524, DIG. 1; 285/921

(56) References Cited

U.S. PATENT DOCUMENTS 3,081,950 * 3/1963 Rinkewich ..... 239/394
4,347,981 * 9/1982 Hayes ..... 239/394
5,232,162 * 8/1993 Chih ..... 239/394
5,683,035 * 11/1997 Wang ..... 239/394
5,746,375 * 5/1998 Guo ..... 239/394 X

* cited by examiner

*Primary Examiner*—David A. Scherbel
*Assistant Examiner*—Steven J. Ganey
(74) *Attorney, Agent, or Firm*—Harrison & Egbert

(57) ABSTRACT

A water sprinkling device is composed of a base, a rotary member, and an urging member. The base is provided with a water outlet and a connector for connecting the base with a water source. The rotary member is rotatably mounted on the base and provided with a plurality of nozzles. The rotary member is provided around the bottom edge thereof with a circular rib capable of being retained securely by a retainer of the base so as to prevent the water leakage from the water outlet.

3 Claims, 6 Drawing Sheets

WATER SPRINKLE DEVICE

FIELD OF THE INVENTION

The present invention relates generally to a water sprinkling device, and more particularly to a base of the water sprinkling device.

BACKGROUND OF THE INVENTION

As shown in FIGS. 1–3, a water sprinkling device of the prior art is composed of a base 11, a rotary member 17, and an urging member 22.

The base 11 comprises a handle 12, a connector 13, an water outlet 14 having a washer 15, and a slot 16.

The rotary member 17 is rotatably mounted on the base 11 by a spindle 18 and is provided with a plurality of nozzles 20 in communication with the water outlet 14 via the connection tubes 19. The rotary member 17 is further provided with a locating slot 21.

The urging member 22 of an L-shaped construction is Located in the slot 16 of the base 11 and is composed of an arcuate rod 23 and an urging rod 24 corresponding in location to the locating slot 21 of the rotary member 17.

Such a prior art water sprinkler as described above is defective in design in that the water outlet 14 is vulnerable to leakage, and that the motion of the rotary member 17 is hindered at such time when the rotary member 17 is tightened to prevent the leakage of the water outlet 14.

SUMMARY OF THE INVENTION

The primary objective of the present invention is to provide a leakproof water sprinkler.

In keeping with the principle of the present invention, the foregoing objective of the present invention is attained by a water sprinkling device having a base, a rotary member, and an urging member. The base is provided with a water outlet and two retainers contiguous to the water outlet. The rotary member is provided around the bottom edge thereof with a circular rib, which is retained securely by the retainers so as to prevent the water leakage of the water outlet of the base.

The foregoing objective, features and functions of the present invention will be more readily understood upon a thoughtful deliberation of the following detailed description of an embodiment of the present invention with reference to the accompanying drawings.

DETAILED DESCRIPTION OF THE EMBODIMENT

Figure 1:
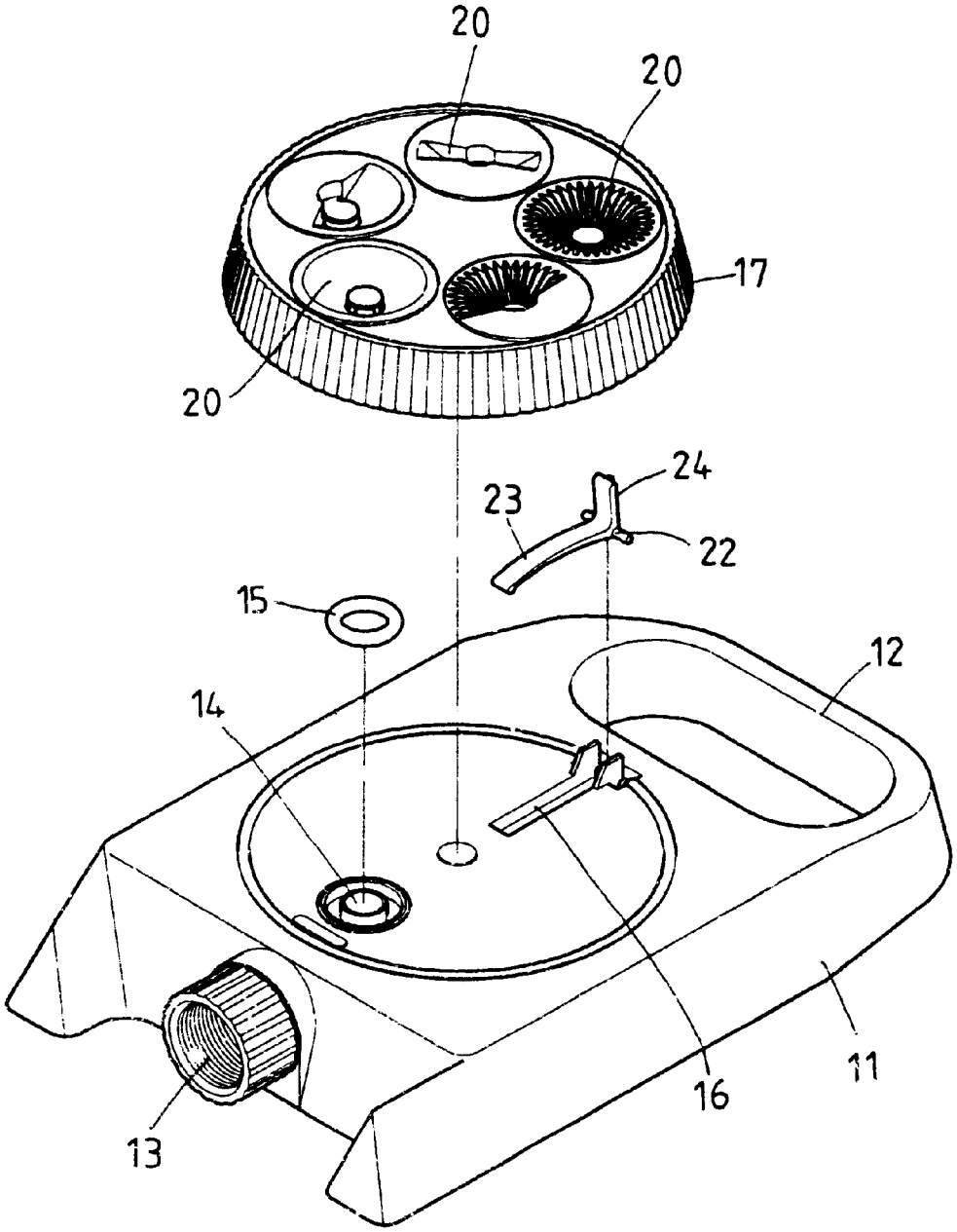
FIG. 1 PRIOR ART
FIG. 1 shows an exploded view of a water sprinkler of the prior art.
Figure 2:
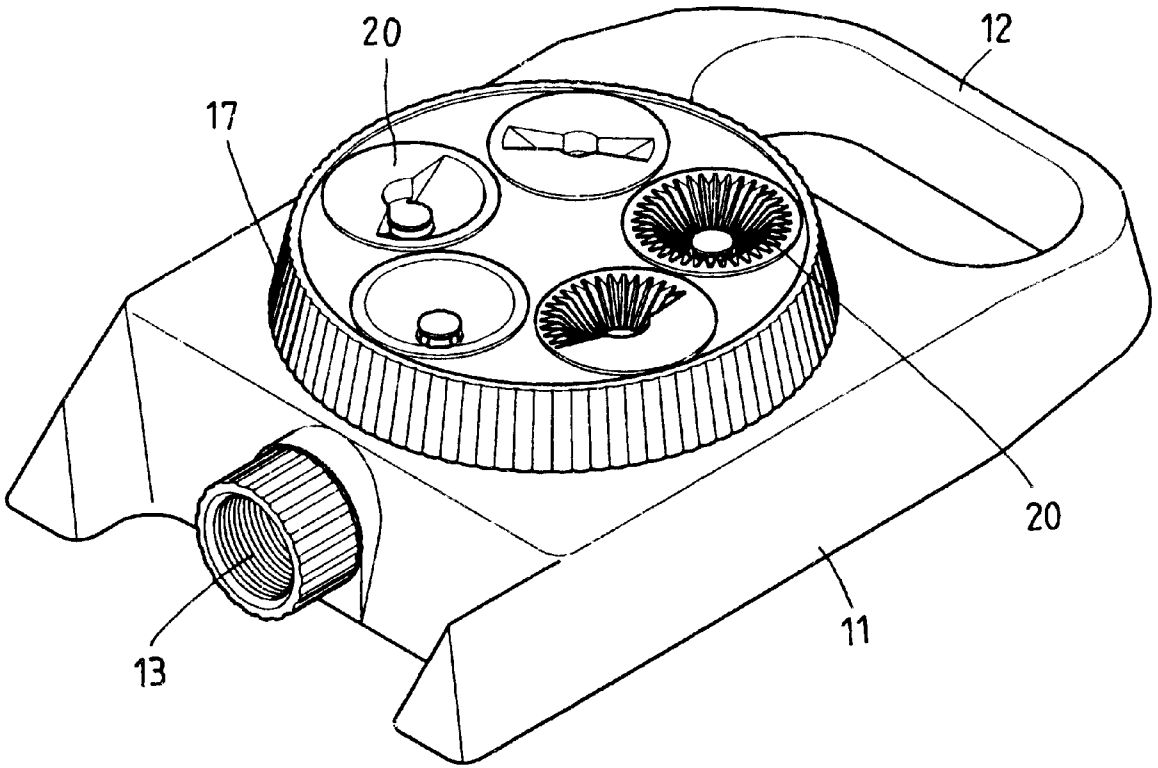
FIG. 2 PRIOR ART
FIG. 2 shows a schematic view of the water sprinkler of the prior art in combination.
Figure 3:
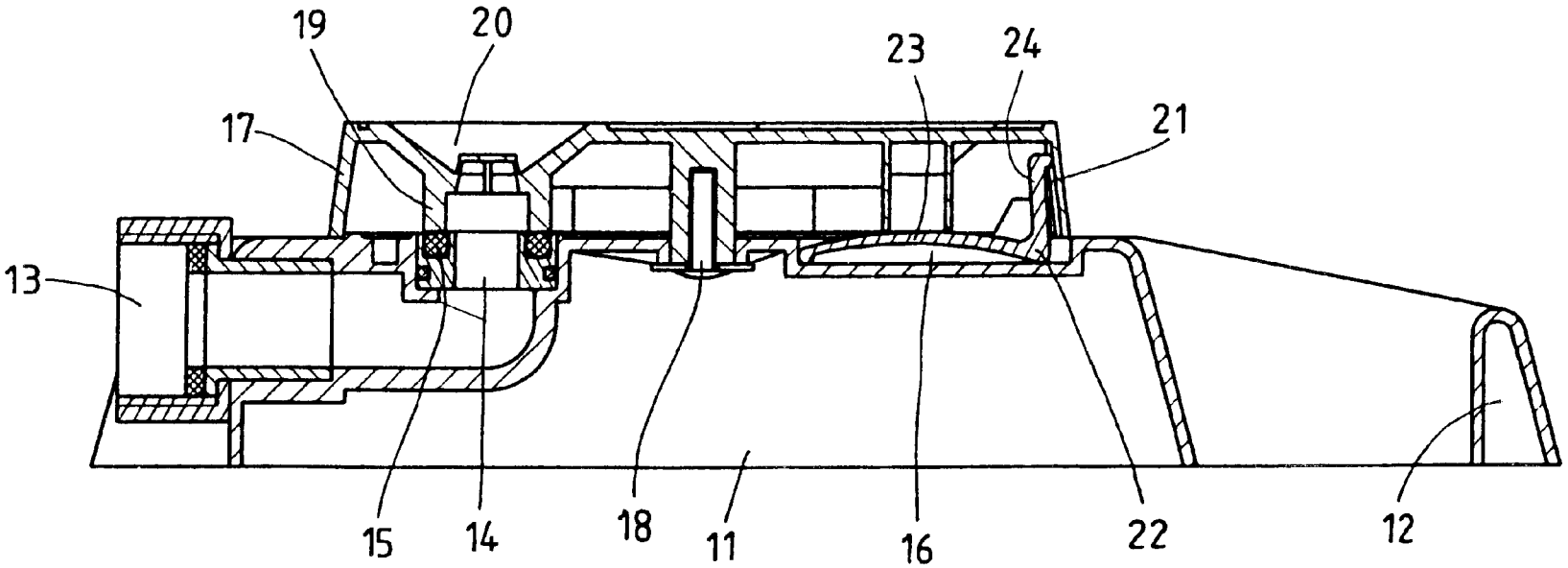
FIG. 3 PRIOR ART
FIG. 3 shows a sectional view of the water sprinkler of the prior art in combination.
Figure 4:
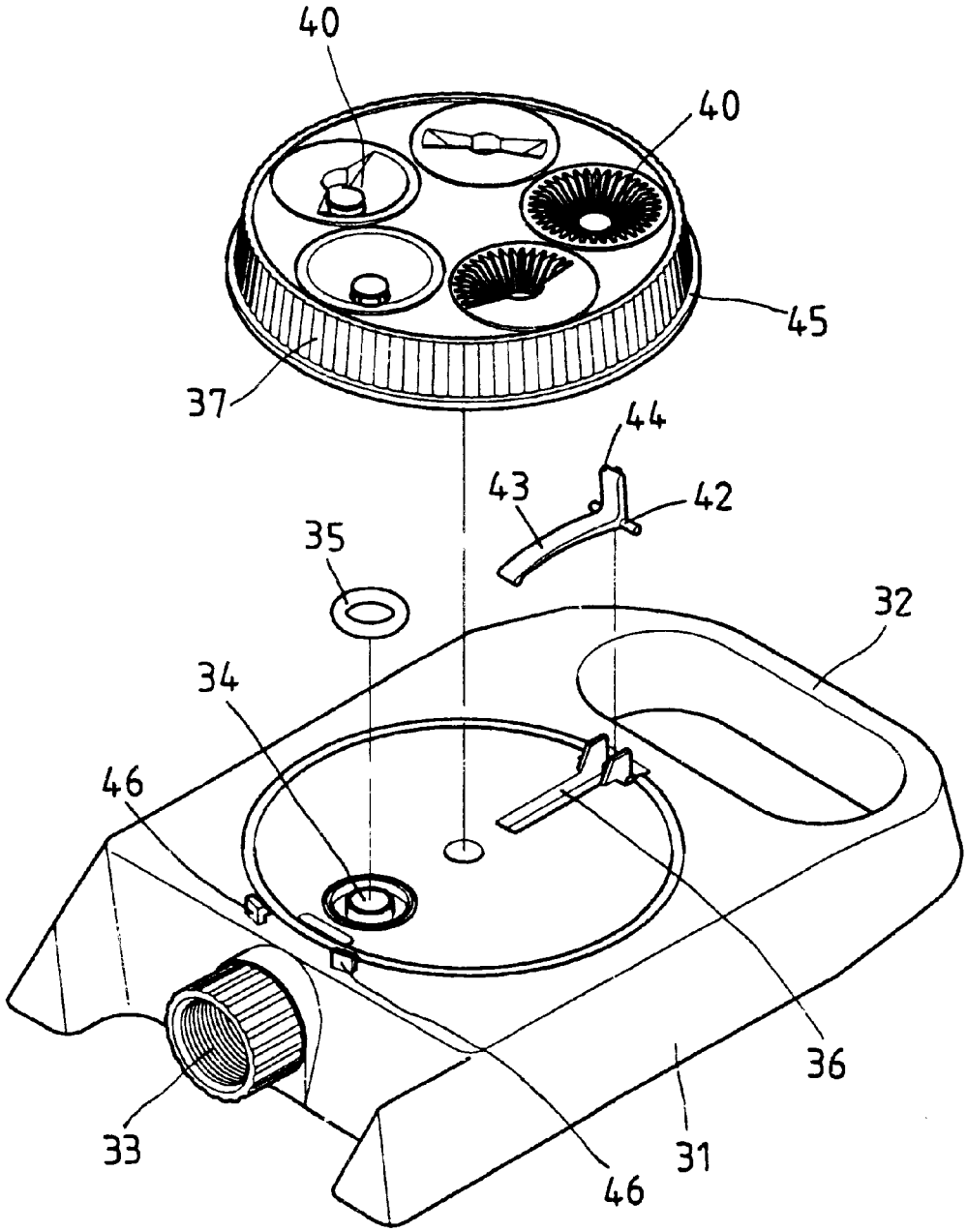
FIG. 4 shows an exploded view of a water sprinkler of the p,resent invention.
Figure 5:
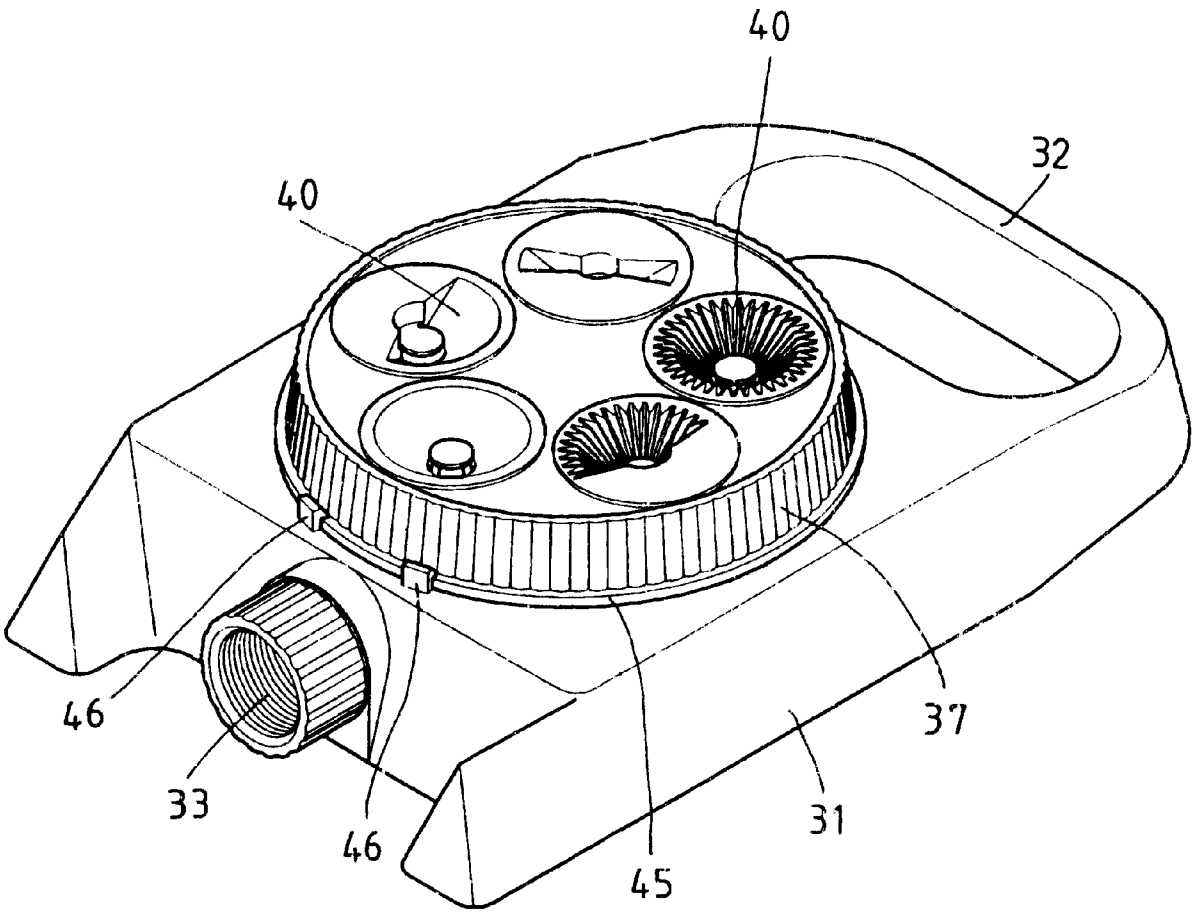
FIG. 5 shows a schematic view of the water sprinkler of the present invention in combination.
Figure 6:
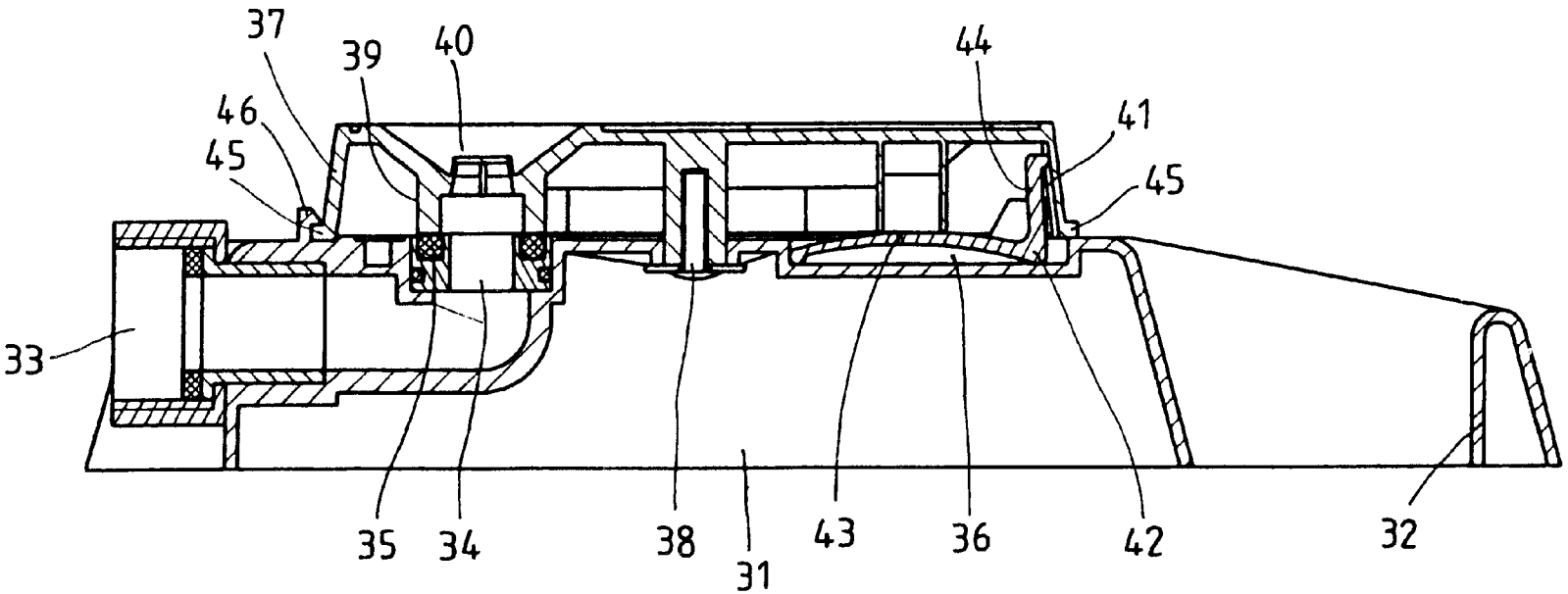
FIG. 6 shows a sectional view of the water sprinkler of the present invention in combination.

As shown in FIGS. 4, 5 and 6, a water sprinkling device embodied in the present invention is composed of a base 31, a rotary member 37, and an urging member 42.

The base 31 is composed of a handle 32, a connector 33 for connecting the base 31 with a water supply, a water outlet, 34 in communication with the connector 33, a washer 35 fitted over the water outlet 34, and a slot 36.

The rotary member 37 is of a disklike construction and is mounted rotatably on the base 31 by means of a spindle 38. The rotary member 37 is provided with a plurality of nozzles 40 each having a tubular portion 39. The rotary member 37 is further provided in the inner edge thereof with a plurality of locating slots 41 opposite in relation to the nozzles 40.

The urging member 42 is of an L-shaped construction and is located in the slot 36 of the base 31. The urging member 42 is formed of an elastic arcuate portion 43 and an urging portion 44 corresponding in location to the locating slot 41.

As illustrated in FIG. 6, the rotary member 37 is provided around the bottom edge thereof with a circular rib 45, whereas the base 31 is provided with one or more retainers 46 contiguous to the water outlet 34 and engageable with the circular rib 45. In combination, the rotary member 37 is mounted on the base 31 such that the circular rib 45 of the rotary member 37 is securely retained by the retainers 46 of the base 31, and that the washer 35 and the tubular portion 39 are in an intimate contact to prevent the water leakage from the water outlet 34.

The embodiment of the present invention described above is to be regarded in all respects as being merely illustrative and not restrictive. Accordingly, the present invention may be embodied in other specific forms without deviating from the spirit thereof. The present invention is therefor to be limited only by the scopes of the following appended claim.

I claim:

1. A water sprinkling device comprising:

a base having a handle, said base having a connector adapted for connecting said base to a water supply, said base having a water outlet in communication with said connector, said water outlet having a washer extending therearound, said base having a slot formed therein;

a rotary member mounted rotatably on said base by a central spindle, said rotary member having a plurality of nozzles arranged individually correspond in location to said water outlet when said rotary member is rotated about said central spindle each of, said plurality of nozzles having a tubular portion extending therefrom, said rotary member having a locating slot formed in an inner surface thereof; and an urging member located in said slot of said base said urging member having an elastic arcuate portion and an urging portion, said urging portion positioned so as to selectively engage said locating slot of said rotary member, said base having at least one retainer contiguous to said water outlet, said rotary member having a circular rib extending around a bottom edge of said rotary member adjacent to said base and outwardly therefrom, said retainer engaging an exterior surface of said circular rib so as to retain said bottom edge of said rotary member against a top surface of said base such that said tubular portion has an end compressively engaged against a surface of said washer.

2. The water sprinkling device according to claim 1, said retainer being positioned at a side of said control spindle opposite said urging member.

3. The water sprinkling device according to claim 1, said retainer comprising two retainers being radially spaced from each other, said two retainers positioned on an opposite side of said central spindle from said urging member.

* * * * *